United States Patent [19]

Honkura et al.

[11] Patent Number: 5,009,723

[45] Date of Patent: Apr. 23, 1991

[54] METHOD FOR MANUFACTURING HIGH STRENGTH NON-MAGNETIC STAINLESS STEEL

[75] Inventors: Yoshinobu Honkura, Kounan; Toru Matsuo; Kouji Murata, both of Tokai, all of Japan

[73] Assignee: Aichi Steel Works, Ltd, Aichi, Japan

[21] Appl. No.: 375,460

[22] Filed: Jul. 5, 1989

Related U.S. Application Data

[60] Division of Ser. No. 222,382, Jul. 19, 1988, abandoned, which is a continuation of Ser. No. 6,241, Jan. 20, 1987, abandoned, which is a continuation of Ser. No. 714,044, Mar. 18, 1985, abandoned.

[30] Foreign Application Priority Data

Mar. 20, 1984 [JP] Japan ..... 59-53695

[51] Int. Cl.[5] ..... C21D 8/00

[52] U.S. Cl. ..... 148/12 E; 72/274; 72/700

[58] Field of Search ..... 420/59, 65; 148/327, 148/12 E; 72/274, 700

[56] References Cited

U.S. PATENT DOCUMENTS 3,151,979 10/1964 Carney et al. ..... 420/59

4,493,733 1/1985 Yamamoto et al. ..... 420/59

*Primary Examiner*—Deborah Yee

*Attorney, Agent, or Firm*—Berman, Aisenberg & Platt

[57] ABSTRACT

A high strength non-magnetic stainless steel comprising, by weight ratio, less than 0.20% C, less than 1.00% Si, 14–16% Mn, less than 0.005% S, 0.2–1.0% Ni, 15–19% Cr, 0.30–0.40% N, and Fe and other impurity elements, of which C+N constitutes 0.40–0.55% and the Mn equivalent equals 30–33. The stainless steel has a hardness more than Hv 500, a magnetic permeability less than 1.01 after drawing, the steel may be suitably used as the steel for the micro shafts of video tape recorders and electromagnetic valves.

7 Claims, 3 Drawing Sheets

METHOD FOR MANUFACTURING HIGH STRENGTH NON-MAGNETIC STAINLESS STEEL

RELATED APPLICATIONS

This application is a division of application Ser. No. 222,382, filed July 19, 1988 (now abandoned), which is a continuation of application Ser. No. 006,241 (now abandoned), filed Jan. 20, 1987, which is a continuation of application Ser. No. 714,044 (now abandoned), filed Mar. 18, 1985.

BACKGROUND OF THE INVENTION

1. Field of the Invention

This invention relates to a non-magnetic stainless steel which is superior in strength and corrosion resistance and utilized for micro-shafts of video tape recorders (VTR) and electromagnetic valves, and also to a method for manufacturing the stainless steel.

2. Description of the Prior Art

As VTR equipment has become smaller, the driving mechanisms have changed. Most of earlier VTR's employed a belt whereas recent VTR's use a revolving shaft to drive the cartridge directly.

The raw material for a micro-shaft must possess a hardness of more than Hv 500, and its magnetic permeability must not exceed 1.01 after drawing. Conventional SUS420J2 is inferior in non-magnetic properties and cannot meet these requirements.

18Mn-5Cr steel possesses a hardness of over Hv 500 and a magnetic permeability ($\mu$) of less than 1.01. This steel, however, is very inferior in corrosion resistance, though superior in hardness and non-magnetic property after drawing.

Further, low Ni-high Mn stainless steels which possess a high strength and non-magnetic properties are, for example:

0.1C-0.6Si-12.5Mn-1.6Ni-17.5Cr-0.35N (ASTM XM-28)

0.05C-0.6Si-13Mn-3.2Ni-17.5Cr-0.32N (ASTM XM-29)

0.1C-0.6Si-16Mn-0.1Ni-18Cr-0.4(ASTM XM-31)

0.18C-0.6Si-15Mn-1.25Ni-17Cr-0.35N (205)

ASTM XM-28 possesses hardness exceeding Hv 500, but its magnetic permeability is 1.05.

ASTM XM-29 is superior in that its magnetic permeability is less than 1.01, but it does not possess a hardness of more than Hv 500.

ASTM XM-31 and 205 have their magnetic permeability less than 1.00 like XM-29 but they cannot stably provide hardness more than Hv 500. Each of ASTM XM-31 and 205 are inferior also in hot-workability and ductility after drawing because of a large amount of Mn contained therein. Wire drawing of more than 50% was tested to be difficult with these steels.

All of these steels are low Ni and high Mn steels, and therefore they are inferior to SUS304 in corrosion resistance and ductility after drawing.

SUMMARY OF THE INVENTION

One of the object of the present invention is to provide a high strength non-magnetic stainless steel having a hardness more than Hv 500 and a magnetic permeability less than 1.01 after drawing.

Another object of the present invention is to provide a high strength non-magnetic stainless steel which has, in addtion to the hardness, magnetic permeability and a high corrosion resistance.

Further object of the present invention is to provide a method for manufacturing the high strength non-magnetic stainless steel having a high hardness, low magnetic permeability and a high corrosion resistance.

Thus, the present invention provides a stainless steel comprising, by weight, not more than 0.20% carbon, not more than 1.00% silicon, 14–16% manganese, not more than 0.005% sulfur, 0.2 –1.0% nickel, 15–19% chromium, 0.30–0.40% nitrogen, said carbon and said nitrogen constituting 0.40–0.55% and Mn equivalent being 30–33, the reminder being iron together with impurities.

BRIEF DESCRIPTION OF THE DRAWING

A better understanding of the prior art and of the present invention will be obtained by reference to the detailed description below and to the attached drawings, in which.

DETAILED DESCRIPTION OF THE INVENTION

The present invention was made as a result of research in the effects of alloying elements on the strength, non-magnetic properties, and corrosion resistance of Cr-Mn-N low Ni stainless steels. The high strength non-magnetic stainless steel of this invention needs to satisfy, firstly, a magnetic permeability less than 1.01 and a high work-hardenability required to provide a hardness exceeding Hv 500. The $\gamma$ phase of the high strength non-magnetic stainless steel should be stable even when a high-level drawing is done. Secondly, the high strength non-magnetic stainless steel should contain a large amount of manganese and nitrogen and little nickel to obtain work hardenability, yet the corrosion resistance, hot-workability, and ductility after drawing of the stainless steel do not decrease. The high strength non-magnetic stainless steel has an optimal composition of such alloying elements as carbon, manganese, chromium, nitrogen, and nickel.

The present invention has found that the magnetic permeability is determined by Mn equivalent obtained by the following equation after having researched the effects of such alloying elements as manganese, carbon, chromium, nichel, nitrogen, and silicon on the magnetic permeability:

$$Mn\ equivalent = Mn + 20C + 0.4Cr + Ni + 18N + 0.35Si$$

Figure 2:
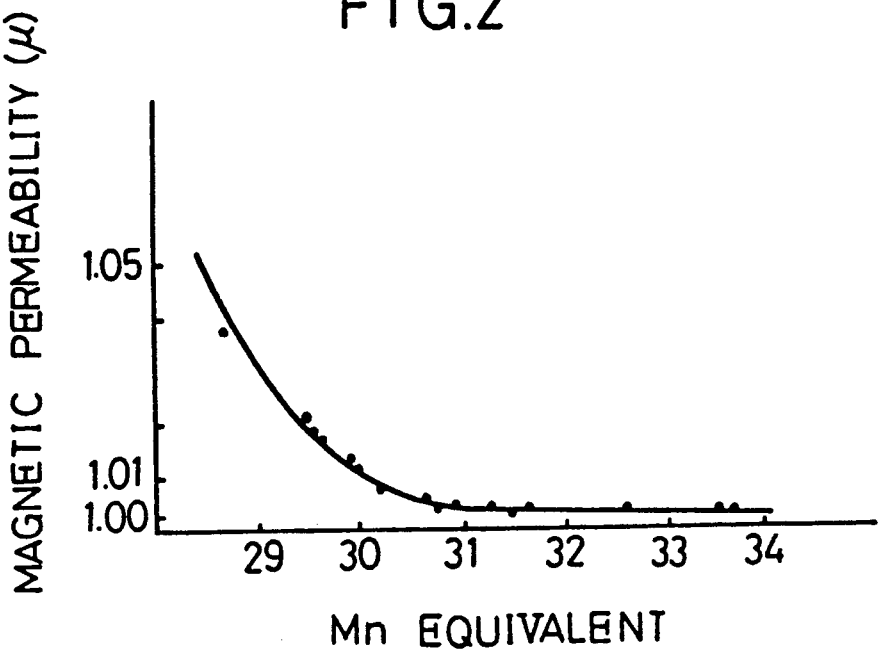
FIG. 2 is a diagram illustrating the influence of the Mn equivalent in relation to magnetic permeability after drawing.

The present invention has also formed that the Mn equivalent is required to be equal to or more than 30 in order to obtain a magnetic permeability equal to or less than 1.01 at a drawing rate (percentage of a reduction of area) of 60% as illustrated in FIG. 2.

Figure 1:
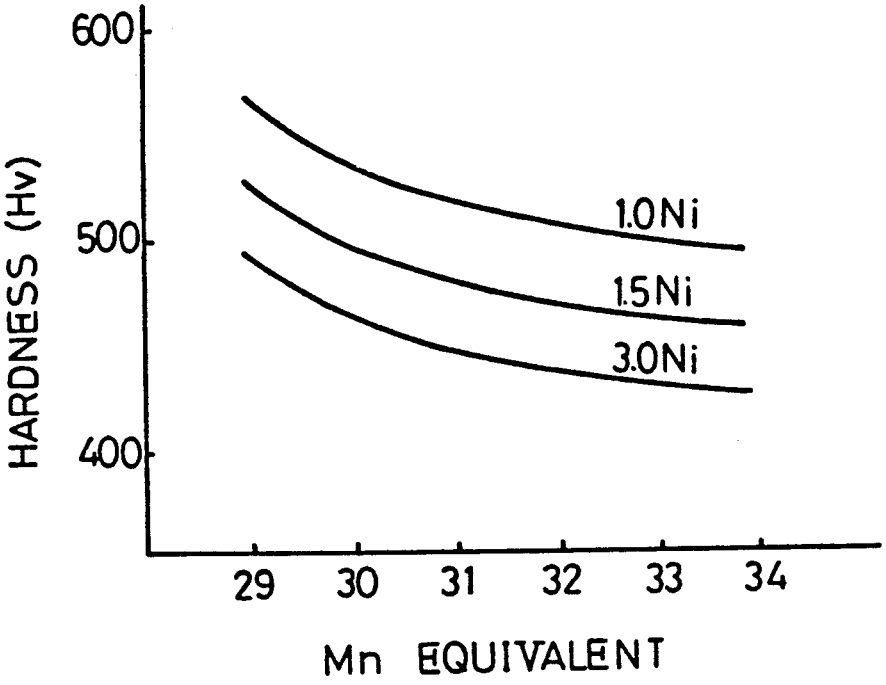
FIG. 1 is a diagram illustrating the influence of the Mn equivalent and Ni in relation to the hardness after drawing.

FIG. 1 shows effects of Mn equivalent and Ni amount on the hardness after 60% drawing, C+N content being constant at 0.47%. The hardness decreases as the Ni amount or Mn equivalent increases. The Mn equivalent should be equal to or less than 33 and the Ni amount needs to be equal to or less than 1.0% in order to obtain a hardness more than Hv 500. Further, it is preferable to keep the Mn equivalent at the minimum required to obtain non-magnetic property because the hot-workability, hardness after drawing and ductility decrease as the Mn equivalent increases.

Figure 3:
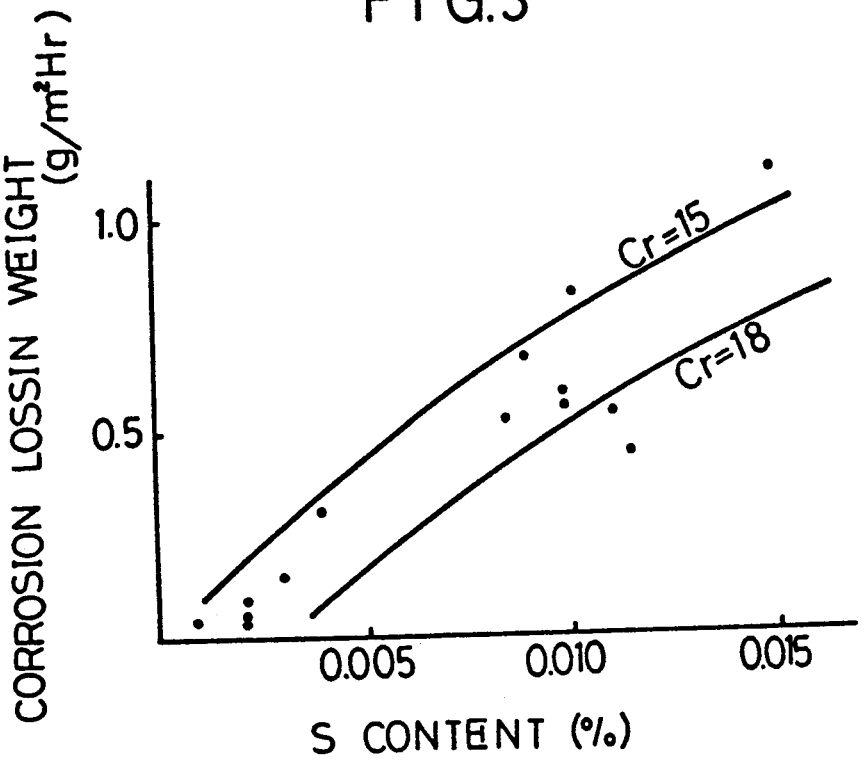
FIG. 3 is a diagram illustrating the influence of S in relation to corrosion resistance.
Figure 4:
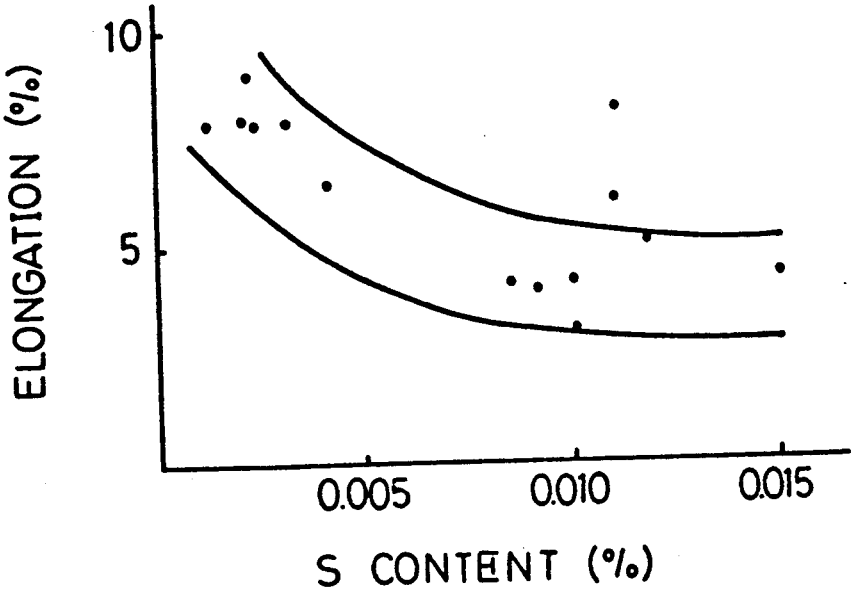
FIG. 4 is a diagram illustrating the influence of S in relation to elongation after drawing.

FIGS. 3 and 4 show the relationship of S content and the corrosion resistance and ductility after drawing for a steel containing 0.12% C, 0.61% Si, 14.5% Mn, 17% Cr, 0.8% Ni, and 0.35% N. And, it is apparent from FIGS. 3 and 4 that the decrease of the S content decreases corrosion loss in weight and increases elongation. The corrosion loss of 0.4 $g/m^2$.Hr and elongation more than 5% comparable to those of SUS304 can be obtained by keeping the S amount equal to or less than 0.005%.

0.40–0.55% (C+N) content and equal to or less than 1.0% Ni are kept to obtain a high work-hardenability, such as a hardness exceeding Hv 500.

To stabilize the $\gamma$ phase, the magnetic permeability is kept less than 1.01 by keeping Mn equivalent between 30 and 33.

Further, to compensate the decreases of corrosion resistance due to the decrease of Ni, of the hot-workability and of the ductility after drawing by the increase of N amount, the S amount is kept equal to or less than 0.005% and the Mn equivalent is kept equal to or less than 33.

Thereby, a corrosion resistance, hot-workability and ductility after drawing comparable to those of SUS 304 are obtained.

The steel of the present invention comprises by weight, not more than 0.2% carbon, not more than 1.00% silicon, 14–16% manganese, not more than 0.005% sulfer, 0.2–1.0% nickel, 15–19% chromium, 0.30–0.40% nitrogen, said carbon and said nitrogen constituting 0.40–0.55% and manganese equivalent being 30–33, the reminder being iron together with impurities.

In addition, the steel contains when necessary not more than 0.1% aluminum, not more than 0.020% phosphorus and not more than 0.0050% oxygen to further improve the corrosion resistance, hot-workability and ductility after drawing.

The steel of the present invention is provided with a high work-hardenability.

This steel may be required to be work-hardened to stably obtain hardness more than Hv 500.

Figure 5:
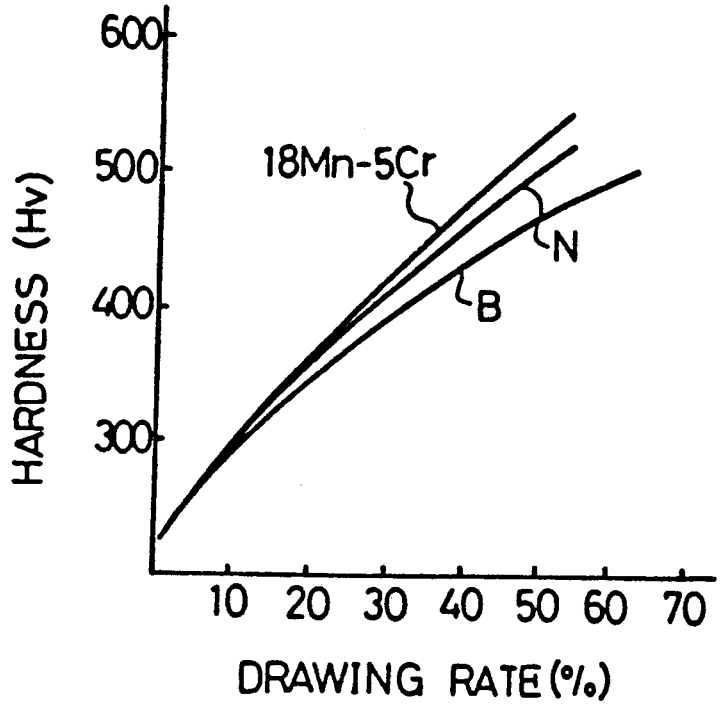
FIG. 5 is a diagram illustrating the relationship between the drawing rates and the hardness after drawing.
Figure 6:
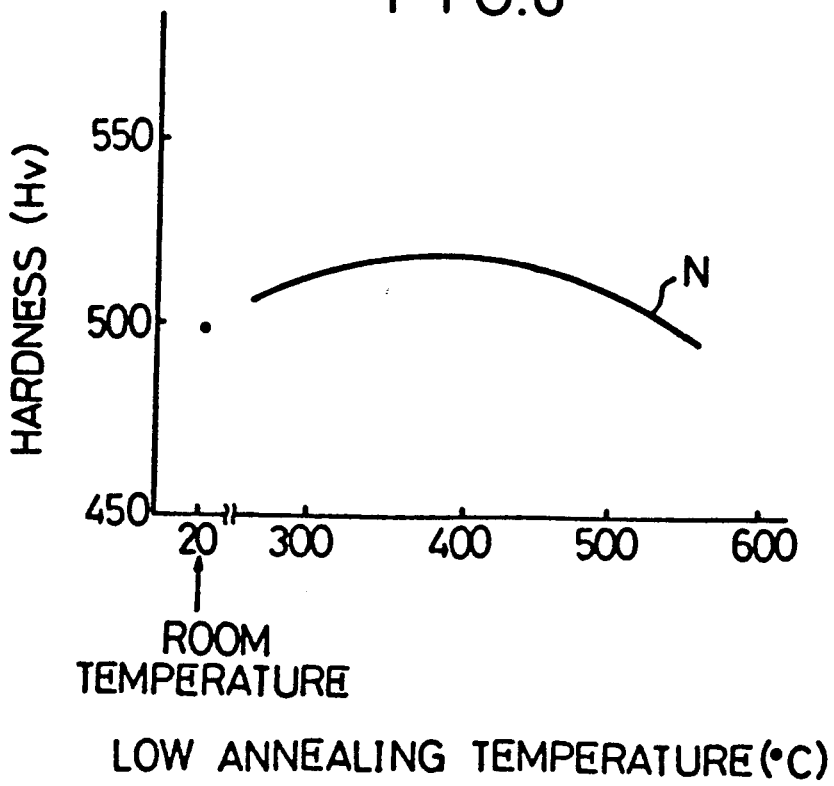
FIG. 6 is a diagram illustrating the relationship between low temperature annealing and the tensile strength and hardness of the steels after drawing.

The steel of the present invention was work-hardened by 50–70% drawing as indicated in FIG. 5. In addition, the steel is annealed at low-temperature 250–550° C. when an additional strength is desired. FIG. 6 shows the relationship between low temperature annealing and the tensile strength and hardness of the steels after drawing. In FIG. 6, the steel at room temperature was not annealed.

The reason for limiting the composition of the steel of the present invention is explained hereunder.

Carbon is an element which contributes to the work hardenability and also stabilizes the $\gamma$ phase. The maximum content of C is limited to 0.20%. The corrosion resistance degrades when the C content exceeds 0.20%.

The Si content which is required for deoxidizing is limited to 1.00%. When contained more than necessary, silicon causes an imbalance of $\delta/\gamma$ and degradation in hot workability.

The minimum content of manganese, one of the main elements of the steel of this invention is 14%.

Manganese contributes to the work-hardenability, the stabilization of the $\gamma$ phase, thereby making the $\gamma$ phase with a high work-hardenability, and increasing the N solid solution.

The minimum content of manganese is determined to be 14%. The Mn content is required to be not less than 14% to obtain these effects.

While, the maximum content of manganese is limited to 16%. When the Mn content exceeds 16%, Mn overstabilizes the $\gamma$ phase and causes the work-hardenability of $\gamma$ phase to decrease. Also, hot workability and corrosion resistance are decreased.

The maximum S content is the steel of the present invention is 0.005%. S decreases the corrosion resistance, hot-workability of the steel of this invention and the ductility of drawn steel. For this reason, the S content in the steel is required to be minimal. And, preferably the S content should be kept to equal to or less than 0.001%.

The minimum Ni content should be 0.2%. Ni stabilizes the $\gamma$ phase and should constitute at least 0.2% of the steel by weight. If the Ni content exceeds 1.0%, the work-hardenability of the $\gamma$ phase and the solid solution of N is decreased. Therefore, the maximum Ni content should be 1.0%.

The minimum Cr content should be 15%. Cr, another main element of the steel of this invention, increases the steel's corrosion resistance, the work-hardenability of the phase, the stabilization of the $\gamma$ phase during drawing, and an increase of solid solution of N. And, the Cr content is required to be more than 15% to obtain these effects.

If the Cr content increases, it cause the disruption of the $\delta/\gamma$ balance at high temperature and a degradation of hot-workability. Therefore, the Cr content should be 19% at most.

Nitrogen, which facilitates the stabilization of the $\gamma$ phase, work-hardenability, and corrosion resistance should contain more than 0.30% of the steel. When the N content exceeds 0.40%, however, nitrogen causes a sharp degradation of the hot-workability, and blow holes develop as the steel ingot solidifies. Therefore, the N content should not exceed 0.40%.

The maximum content of phosphorus and oxygen should be 0.020% and 0.0050% respectively. Phosphorus and oxygen degrade the corrosion resistance, hot workability and ductility after drawing, and must be kept at minimal levels. Preferably, the steel should contain less than 0.015% phosphorus and 0.0040% oxygen.

The maximum Al content should be 0.10%. Aluminum improves the corrosion resistance , the hot-workability, and ductility after drawing. When the Al content exceeds 0.10%, Aluminum, however, degrades hot-workability.

The features of the steel of this invention become more apparent hereunder from the comparison between embodiments of this invention and conventional steels, and comparative steels.

Table 1 shows the chemical compositions of the steel employed for the comparison.

In Table 1, steels A–F are conventional steels; steel A is SUS420J2, steel B is ASTM XM-28, steel C is ASTM XM-29, steel D is ASTM XM-31, steel E is 205, and steel F is SUS304, steels G–J are comparative steels, and steels K–Q are sample steels of the present invention.

TABLE 1

| | CHEMICAL COMPOSITION (WEIGHT %) | | | | | | | | | | | |
|---|---|---|---|---|---|---|---|---|---|---|---|---|
| | C | Si | Mn | P | S | Ni | Cr | N | Al | O | C + N | Mn EQUIVALENT |
| A | 0.31 | 0.46 | 0.75 | 0.027 | 0.010 | 0.08 | 12.87 | 0.01 | 0.008 | 0.0083 | 0.32 | 12.5 |
| B | 0.08 | 0.62 | 12.63 | 0.025 | 0.011 | 1.83 | 17.55 | 0.36 | 0.008 | 0.0075 | 0.44 | 29.8 |
| C | 0.04 | 0.59 | 13.12 | 0.031 | 0.011 | 3.17 | 18.24 | 0.33 | 0.010 | 0.0078 | 0.37 | 30.6 |
| D | 0.10 | 0.67 | 15.98 | 0.029 | 0.010 | 0.08 | 17.81 | 0.40 | 0.009 | 0.0081 | 0.50 | 32.6 |
| E | 0.17 | 0.63 | 15.56 | 0.030 | 0.010 | 1.37 | 17.48 | 0.33 | 0.011 | 0.0087 | 0.50 | 33.5 |
| F | 0.05 | 0.54 | 1.67 | 0.026 | 0.012 | 9.20 | 18.35 | 0.01 | 0.011 | 0.0073 | 0.06 | 19.6 |
| G | 0.12 | 0.64 | 17.34 | 0.028 | 0.008 | 0.58 | 17.46 | 0.34 | 0.010 | 0.0079 | 0.46 | 33.6 |
| H | 0.10 | 0.58 | 14.53 | 0.025 | 0.015 | 0.07 | 14.77 | 0.38 | 0.008 | 0.0072 | 0.48 | 29.8 |
| J | 0.12 | 0.46 | 14.82 | 0.027 | 0.009 | 0.64 | 17.43 | 0.25 | 0.010 | 0.0079 | 0.37 | 29.5 |
| K | 0.10 | 0.63 | 14.36 | 0.024 | 0.002 | 0.69 | 17.56 | 0.33 | 0.010 | 0.0088 | 0.43 | 30.2 |
| L | 0.13 | 0.58 | 14.82 | 0.027 | 0.004 | 0.43 | 15.83 | 0.36 | 0.008 | 0.0071 | 0.49 | 30.9 |
| M | 0.16 | 0.67 | 14.47 | 0.023 | 0.003 | 0.87 | 16.24 | 0.35 | 0.008 | 0.0068 | 0.51 | 31.6 |
| N | 0.12 | 0.72 | 15.76 | 0.022 | 0.001 | 0.63 | 16.46 | 0.31 | 0.008 | 0.0055 | 0.43 | 31.2 |
| P | 0.12 | 0.62 | 14.39 | 0.015 | 0.002 | 0.79 | 16.68 | 0.35 | 0.011 | 0.0038 | 0.47 | 30.8 |
| Q | 0.15 | 0.57 | 14.76 | 0.012 | 0.002 | 0.65 | 17.29 | 0.33 | 0.081 | 0.0028 | 0.48 | 31.5 |

TABLE 2

| | HARDNESS (Hv) | | | | | |
|---|---|---|---|---|---|---|
| | AFTER DRAWING | AFTER LOW TEMPERATURE ANNEALING | MAGNETIC PERMEABILITY (μ) | CORROSION RESISTANCE ($g/m^2 \cdot Hr$) | ELONGATION (%) | HOT-WORKABILITY |
| A | 520 | — | not less than 10 | 2.21 | — | O |
| B | 470 | 495 | 1.012 | 0.55 | 6 | O |
| C | 435 | 450 | 1.008 | 0.52 | 8 | O |
| D | 525 | 550 | 1.003 | 0.60 | 3 | X |
| E | 495 | 520 | 1.003 | 0.56 | 4 | X |
| F | 415 | 445 | 2.15 | 0.42 | 5 | O |
| G | 495 | 520 | 1.003 | 0.52 | 4 | X |
| H | 560 | 581 | 1.021 | 1.15 | 4 | X |
| J | 492 | 518 | 1.019 | 0.67 | 4 | X |
| K | 515 | 540 | 1.008 | 0.05 | 8 | O |
| L | 532 | 550 | 1.005 | 0.32 | 6 | O |
| M | 521 | 549 | 1.004 | 0.17 | 7 | O |
| N | 503 | 521 | 1.003 | 0.04 | 8 | O |
| P | 510 | 541 | 1.006 | 0.08 | 9 | O |
| Q | 515 | 525 | 1.003 | 0.10 | 8 | O |

Table 2 shows the hardness magnetic permeability, corrosion resistance, ductility, and hot-workability of steels A–Q. shown in Table 1.

The hardness, magnetic permeability, corrosion resistance and ductility of the steels are measured after drawing (percentage of a reduction of area 60%) and after a low temperature annealing at 400°C. for 20 minutes.

The corrosion resistance was measured as the corrosion weight loss of each of the steels which were immersed in an 3.5% NaCl+2% $H_2O_2$ aqueous solution at 40°C. for 48 hours.

The hot-workability was measured whether or not the occurrence of cracks in the steels when 300 kg ingots of the steel were pressed. O indicates those steels in which cracks did not occur, and X indicates those steels in which cracks occurred.

The conventional steel A is superior in the hardness Hv 520 after 60% drawing, but is inferior in the magnetic permeability which far exceeding 1.010 and the corrosion resistance which far exceeding 0.50 $g/m^2 \cdot Hr$.

The conventional steel B is superior in the ductility and hot-workability, yet the steel B is inferior in the hardness which is Hv 470, magnetic permeability 1.012 and corrosion resistance 0.55 $g/m^2 \cdot Hr$.

The conventional steel C is superior in magnetic permeability, yet inferior in hardness which is Hv 435 and corrosion resistance 0.52 $g/m^2 \cdot Hr$.

The conventional steel D is superior in hardness and magnetic permeability, yet inferior in corrosion resistance, ductility, and hot-workability.

The conventional steel E is superior in hardness Hv 520 after a low temperature annealing and magnetic permeability which is 1.003, yet inferior in corrosion resistance, ductility, and hot-workability.

The conventional steel F is superior in corrosion resistance, ductility and hot-workability, yet inferior in hardness which is Hv 415, magnetic permeability which is 2.15.

None of the conventional steels can provide a high level of hardness, a low magnetic permeability and a high corrosion resistance together.

As for the comparative steels:

The steel G is superior in magnetic permeability and corrosion resistance, yet inferior in hot-workability and hardness which is Hv 495 after drawing because of a decrease in work-hardenability of the $\gamma$ phase due to a large amount of Mn content, 17.34%.

The comparative steel H is superior in hardness, but inferior in magnetic permeability which is 1.021 and corrosion resistance which is 1.15 $g/m^2 \cdot Hr$ because of a low Mn equivalent 29.8 and a low Cr which is 14.77%.

The comparative steel J is inferior in hardness which is Hv 492, magnetic permeability which is 1.019 and corrosion resistance which is 0.67 $g/m^2 \cdot Hr$ because of a low manganese equivalent 29.5 and a low nitrogen 0.25%.

The steels K-Q of the present invention contain an optimal amount of Mn, C, Cr, Ni, N and an Mn equivalent of 30–33, thereby the steels K-Q possess hardnesses exceeding Hv 500 after drawing and more than Hv 520 after a low temperature annealing. The magnetic permeabilities of steels K-G are less than 1.010 after 60% drawing, and corrosion losses by weight less than 0.50 g/m Hr.

The steels K-Q are satisfactory in hardness, magnetic permeability, corrosion resistance and superior in ductility and hot-workability.

The steels of the present invention possess a magnetic permeability comparable to ASTM XM-29.31 and a corrosion resistance comparable to SUS304, and a superiority in ductility and hot workability as set forth above. Therefore, the steels of this invention and the method for manufacturing the same can be effectively employed for high strength non-magnetic stainless steels used for micro-shafts of VTR's and electromagnetic valves.

What is claimed is:

1. A method for manufacturing a high strength non-magnetic stainless steel comprising the steps of preparing a steel composed of, by weight, not more than 0.20% carbon, not more than 1.00% silicon, 14–16% manganese, not more than 0.003% sulfur, 0.2–1.0% nickel, 15–19% chromium, 0.30–0.40% nitrogen, the remainder being iron together with impurities said carbon and said nitrogen constituting 0.40–0.55% and the manganese equivalent being 30–33 and drawing said steel at a reduction of area in a range of 50–70%.

2. A method for manufacturing a high strength non-magnetic stainless steel comprising the steps of preparing a steel composed of, by weight, not more than 0.20% carbon, not more than 1.00% silicon, 14–16% manganese, less than 0.003% sulfur, 0.2–1.0% nickel, 15–19% chromium, 0.30–0.40% nitrogen, the remainder being iron together with impurities and said carbon and said nitrogen constituting 0.40–0.55% and manganese equivalent being 30–33, drawing said steel at a reduction of area in a range of 50–70% and annealing said steel at a temperature in a range of 250–550° C.

3. A method according to claim 1 for manufacturing a high corrosion resistant stainless steel having a Vickers hardness exceeding 500 Hv, a magnetic permeability of less than 1.01 and a corrosion resistance significantly less than 0.32 $g/m^2 \cdot hr.$ after being immersed in a 3.5% NaCl+2% $H_2O_2$ aqueous solution at 40° C. for 48 hours, the composition of the steel having up to 15.76% manganese.

4. A method according to claim 3 which consists essentially of preparing the steel and drawing said steel at a reduction of area in a range of from 50 to 70%.

5. A method according to claim 3 which consists essentially of preparing the steel, drawing said steel at a reduction of area in a range of from 50 to 70% and annealing said steel at a temperature in a range of from 250° to 550° C.

6. A method for manufacturing a high-strength, high corrosion resistant, non-magnetic stainless steel having a Vickers hardness in excess of 500 HV, a magnetic permeability of less than 1.01 and a corrosion loss of less than 0.2 $g/m^2 \cdot hr.$, the method comprising drawing, at a reduction in area in a range of from 50 to 70%, a steel composed of, by weight, not more than 0.20% carbon, not more than 1.00% silicon, from 14 to 15.76% manganese, not more than 0.003% sulfur, from 0.2 to 1.0% nickel, from 15 to 19% chromium, from 0.30 to 0.40% nitrogen, the remainder being iron together with impurities, the sum of said carbon and said nitrogen constituting from 0.40 to 0.55%, and the manganese equivalent being from 30 to 33.

7. A method according to claim 6 which further comprises annealing the steel at a temperature in the range of from 250° to 550° C.

* * * * *